US008117688B2

(12) United States Patent
Chang

(10) Patent No.: US 8,117,688 B2
(45) Date of Patent: Feb. 21, 2012

(54) AUXILIARY TANK FOR A FLUSH TOILET

(76) Inventor: Shu Ken Chang, Daya Township, Taichung County (TW)

( * ) Notice: Subject to any disclaimer, the term of this patent is extended or adjusted under 35 U.S.C. 154(b) by 261 days.

(21) Appl. No.: 12/694,351

(22) Filed: Jan. 27, 2010

(65) Prior Publication Data

US 2011/0179562 A1 Jul. 28, 2011

(51) Int. Cl.
*E03D 1/22* (2006.01)

(52) U.S. Cl. ..... 4/363

(58) Field of Classification Search ..... 4/363, 415
See application file for complete search history.

(56) References Cited

U.S. PATENT DOCUMENTS 4,371,992 A * 2/1983 Rivera ..... 4/353
5,341,529 A * 8/1994 Serrano ..... 4/665
6,205,595 B1 * 3/2001 Ecker ..... 4/363

* cited by examiner

*Primary Examiner* — Huyen Le
(74) *Attorney, Agent, or Firm* — Ming Chow; Sinorica, LLC

(57) ABSTRACT

An auxiliary tank for the flush toilet, wherein the one end of the pulling line is connected with a floating ball of the auxiliary tank, then the line is wound from a lower pulley to an upper pulley, and passed through a penetrated hole of a hollow tube, finally the other end of the line is connected with a extension arm in a main tank. When the water level in the main tank is full, the extension arm of the water refilling pipe will be hold by the pulling line which is connected with the floating ball, to limit the refilling water into the main tank from the water refilling pipe but from the auxiliary tank. In the light of above, the flush of the toilet is still able to be operated even at the time of water outage or shutting off the water valve. In addition, the water that refills into the auxiliary tank is the recycling water.

3 Claims, 6 Drawing Sheets

PRIOR ART

AUXILIARY TANK FOR A FLUSH TOILET

BACKGROUND OF THE INVENTION

1. Field of the Invention

The present invention relates to a flush toilet. More particularly, the present invention relates to an auxiliary tank which is attached to a main tank of the flush toilet, a floating ball-pulley assembly is provided in such auxiliary tank and is connected with a water refilling mechanism of the main tank, so that the assembly is able to control the supplying water of both tanks 2. Description of Related Art A conventional flush toile is shown in FIG. 6. After the holding water in a water tank 30 has been discharged for flushing the waste, the water will be refilled into the tank 30 via a water refilling pipe 31 automatically. However, when the water supply is suspended or the water valve has been shut off, the water will not be able to refill into the tank 30 automatically, and if the user forgets to refill the water to the tank 30 by themselves, the toilet will thus not be able to use. In addition, if the user refills the water during the water outage, but the water refilling pipe 31 is still under the mode of supplying water automatically, when the water supply is restored, the water will be overflowed from the tank 30 due to the overfilling.

In the light of above, the conventional flush toilet thus contains some improvable defects as below:

1. Inconvenience: If the water supply is suspended or the water valve has been shut off, the water can not be refilled into the tank 30 automatically, therefore the use of the toilet is not convenient; and 2. Instability: If the user refills the water by themselves during the water outage, and if the water refilling pipe 31 is still under the mode of supplying water, when the water is restored, the water will be overflowed from the tank 30 due to the overfilling.

The present invention is intended to improve the above mentioned drawbacks of the conventional flush toilet. The present invention provides improved solutions to the problems of inconvenience and instability of the conventional art which may cause.

SUMMARY OF THE INVENTION

The primary purpose for the present invention is to provide an auxiliary tank for a flush toilet, comprising an auxiliary tank having a floating ball-pulley assembly providing a pulling line which is connected with a floating ball with its one end, and its other end is connected with an extension arm of the water refilling pipe in a main tank, the line is wound from an upper pulley to a lower pulley, then passed through a hollow tube which is installed inside the auxiliary tank. A floating arm which is connected with said extension arm having a flapper cover which is used for covering to a bottom hole of the auxiliary tank. As discussed, the one end of the pulling line is connected with the extension arm of the water refilling pipe, when the water level in the main tank is decreased, the floating arm, which is pivotally connected with the extension arm, will be inclined downwardly, so the flapper cover will be released from covering the hole of the auxiliary tank, and the water stored in the auxiliary tank will then be supplied to the main tank accordingly. In the light of above, the flush of the water in a flush toilet is still able to be operated even at the time of water outage or shutting off the water valve. When the stored water of the auxiliary tank is insufficient, and the water level of the main tank is decreased as well, the floating ball in the auxiliary tank will drop off accordingly to cause the pulling line becoming loose, and that will result in the extension arm to incline downwardly with respect to the water refilling pipe, further to activate the refilling of water into the main tank from the water refilling pipe.

DETAILED DESCRIPTION OF PREFERRED EMBODIMENT

Figure 1:
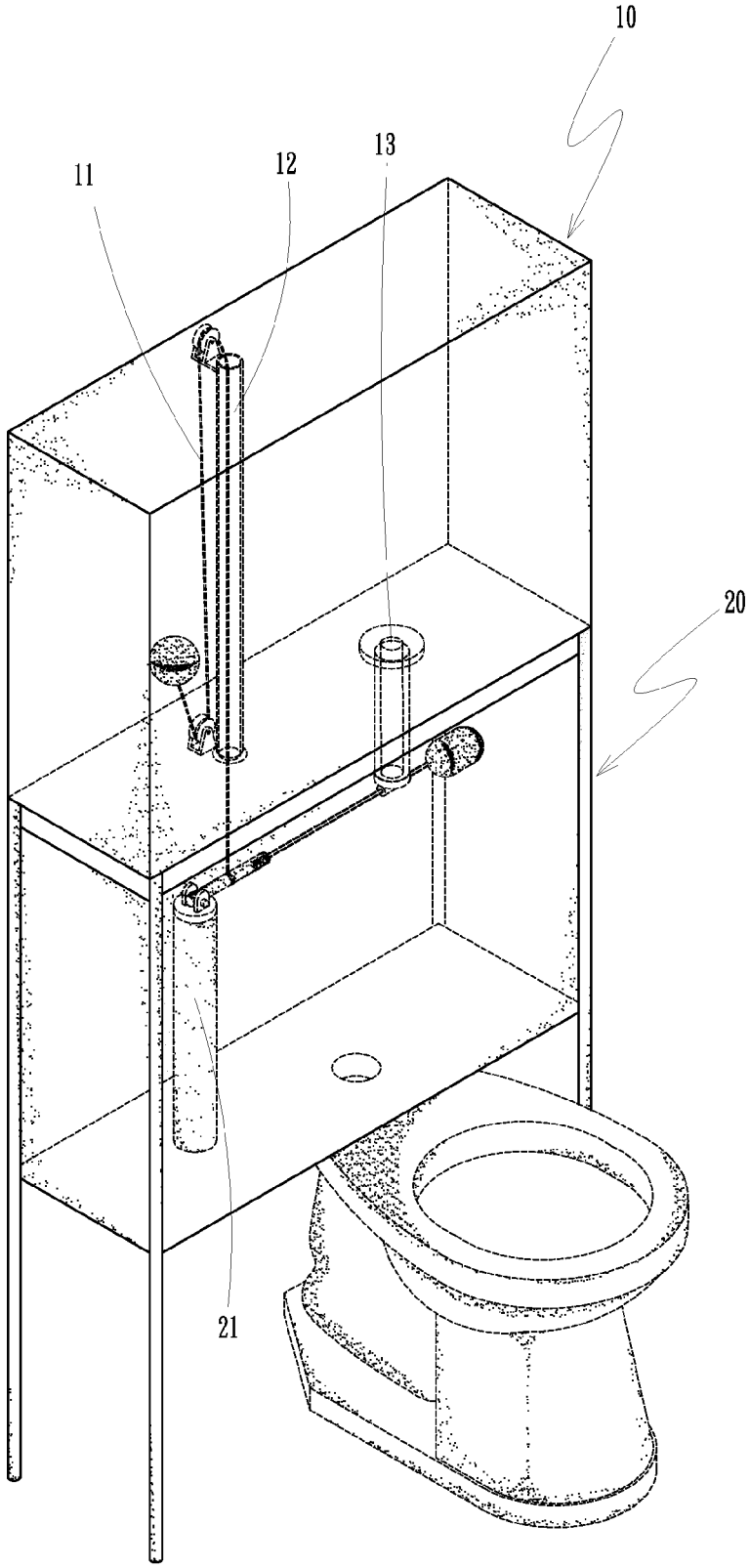
FIG. 1 is a perspective view schematically showing the flush toilet of the present invention.

While this invention is capable of embodiment in many different forms, what is shown in the drawings and described in detail herein is the preferred embodiment of the invention. The preferred embodiment is disclosed with the understanding that the present description is but one example of the principles of the invention and is not intended to limit the broad aspects of the invention to the single embodiment illustrated.

Figure 2:
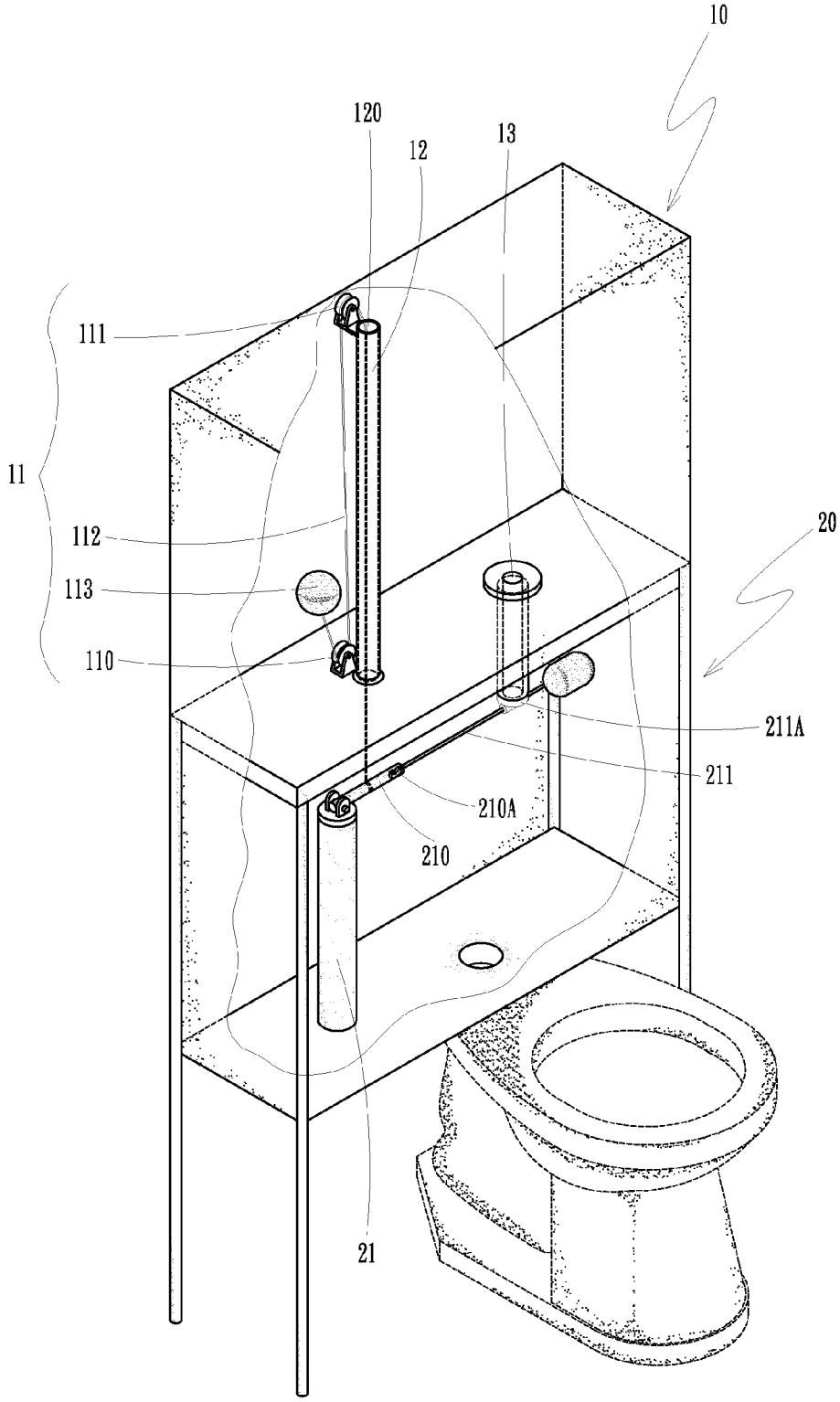
FIG. 2 is a perspective view schematically showing the partially sectional view of the flush toilet of the present invention.

FIGS. 1 to 2 are perspective views schematically showing a preferable embodiment of the present invention.

The flush toilet comprises:

an auxiliary tank 10 having a floating lever 11, a hollow tube 12 and a bottom hole 13, wherein the floating lever 11 further includes a lower pulley 110, an upper pulley 111, a pulling line 112 and a floating ball 113; and the hollow tube 12 further comprises a penetrated hole 120. The pulling line 112 in the auxiliary tank 10 is connected with a floating ball 113 with its one end, then the line 112 is wound from the lower pulley 110 to the upper pulley 111, and passed through a penetrated hole 120 of the hollow tube 12; and a main tank 20 having a water refilling pipe 21 which comprises an extension arm 210 having a pivotal joint 210A, and a floating arm 211 is pivotally assembled to such pivotal joint 210A. In addition, a flapper cover 211A is installed on said floating arm 211. The extension arm 210, which is pivotally connected with the water refilling pipe 21, is connected with the other end of the pulling line 112 where the line 112 has been passed through the penetrated hole 120 of the hollow tube 12. In addition, the flapper cover 211A is covered to the bottom hole 13 of the auxiliary tank 10.

By virtue of the structural description stated above, the present invention fulfills an improvement with regard to the flush toilet thereof.

Figure 3:
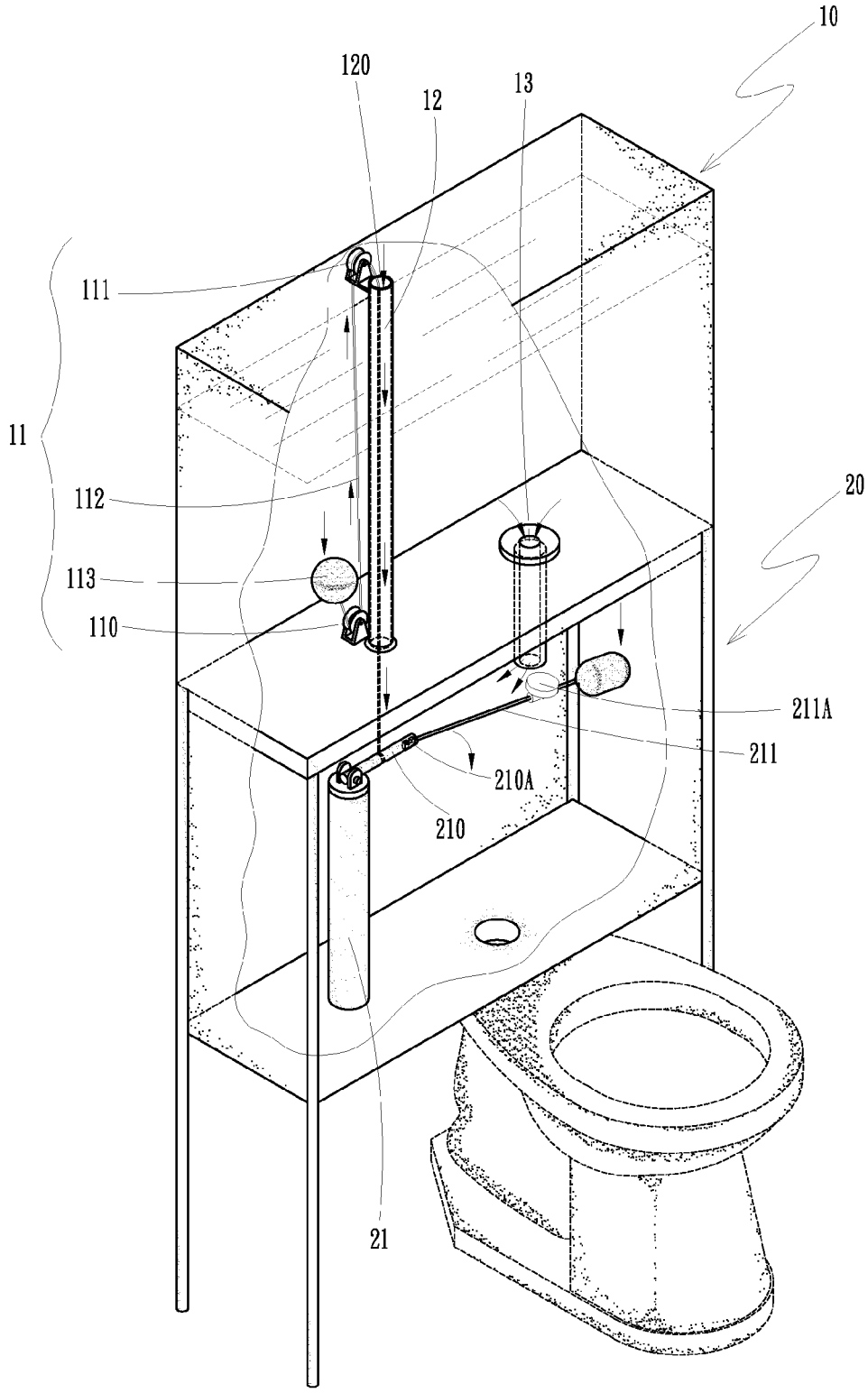
FIG. 3 is a perspective view schematically showing the supplying of water from the auxiliary tank to the main tank of the present invention.
Figure 4:
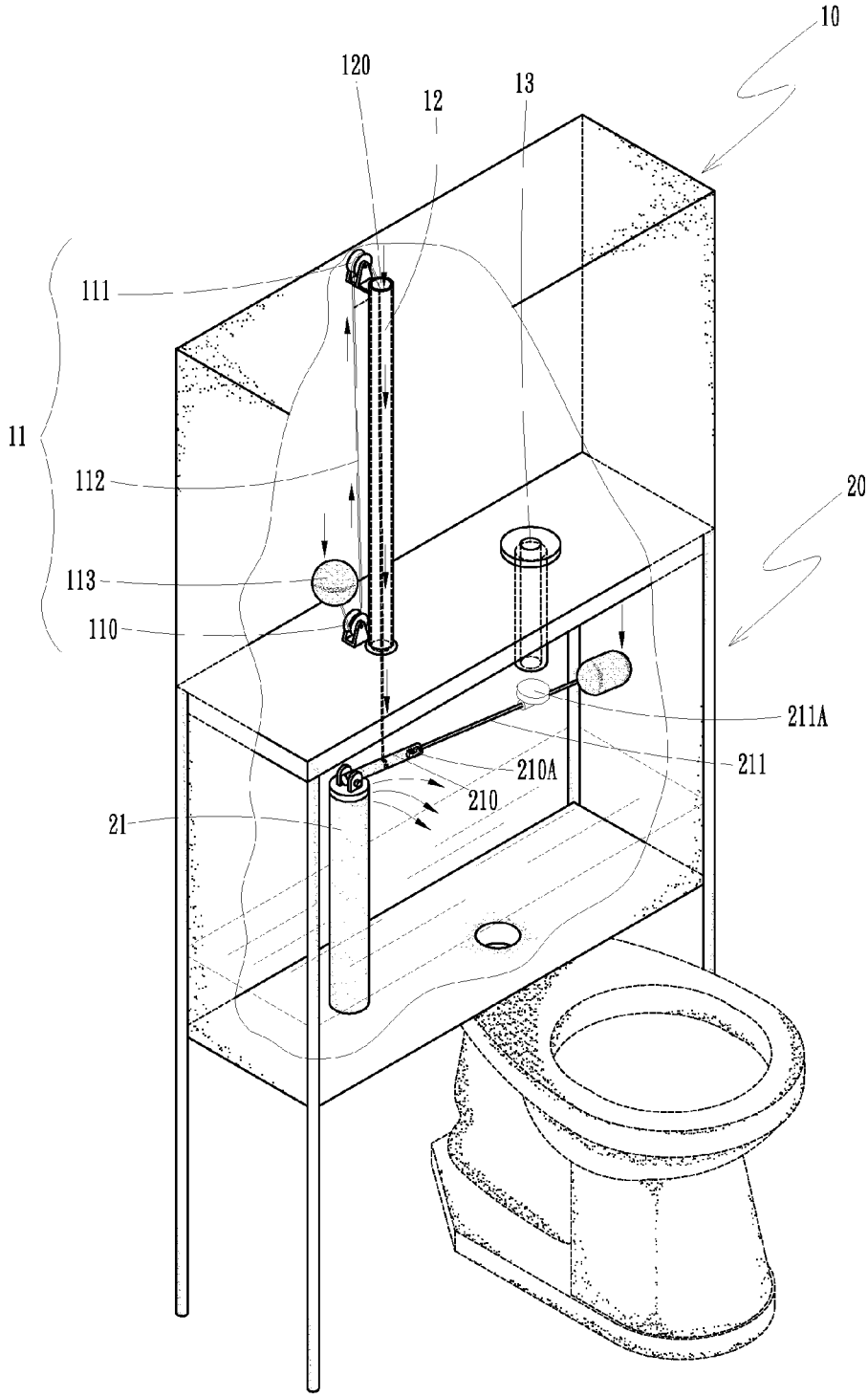
FIG. 4 is a perspective view schematically showing the refilling of water from the water refilling pipe to the main tank of the present invention.
Figure 5:
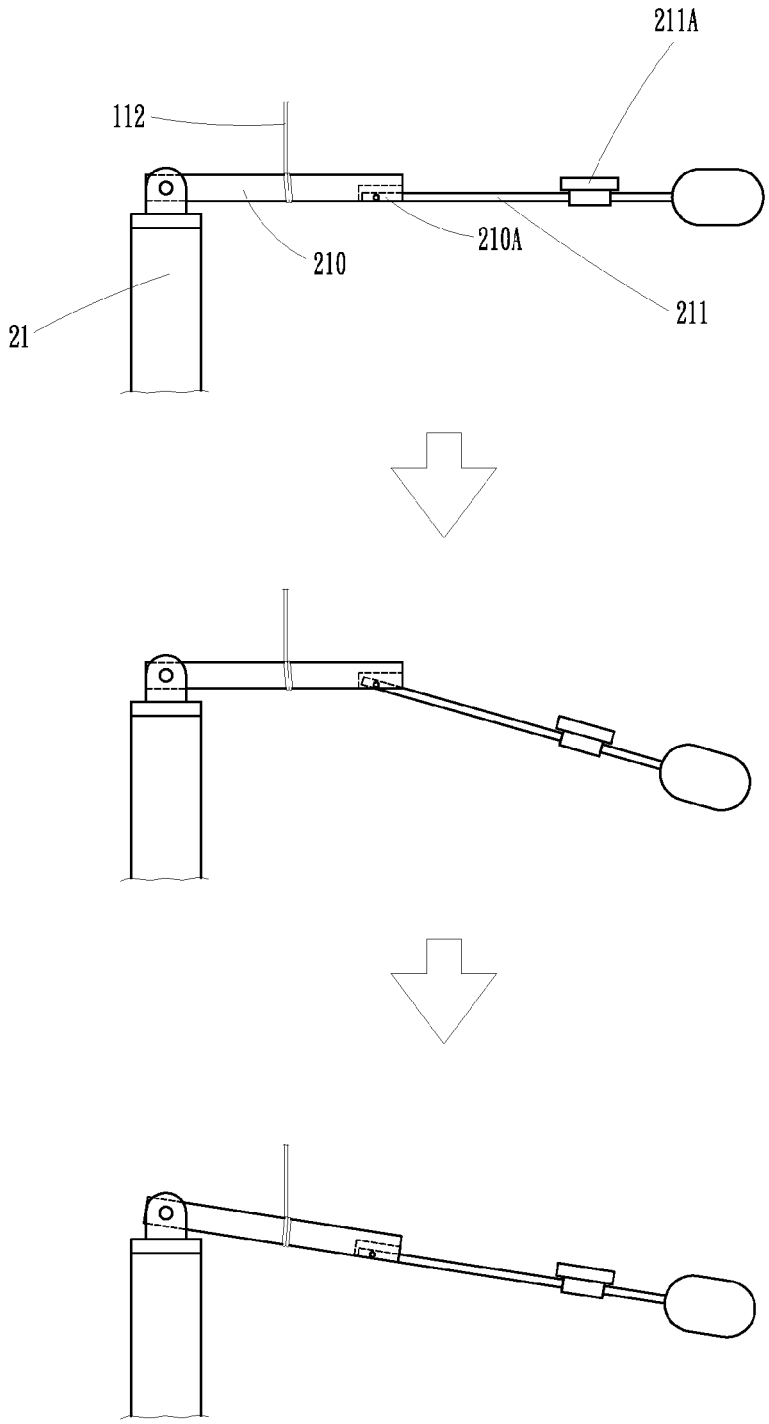
FIG. 5 is a plan view schematically showing the movements of the extension arm and the floating arm of the present invention.
Figure 6:
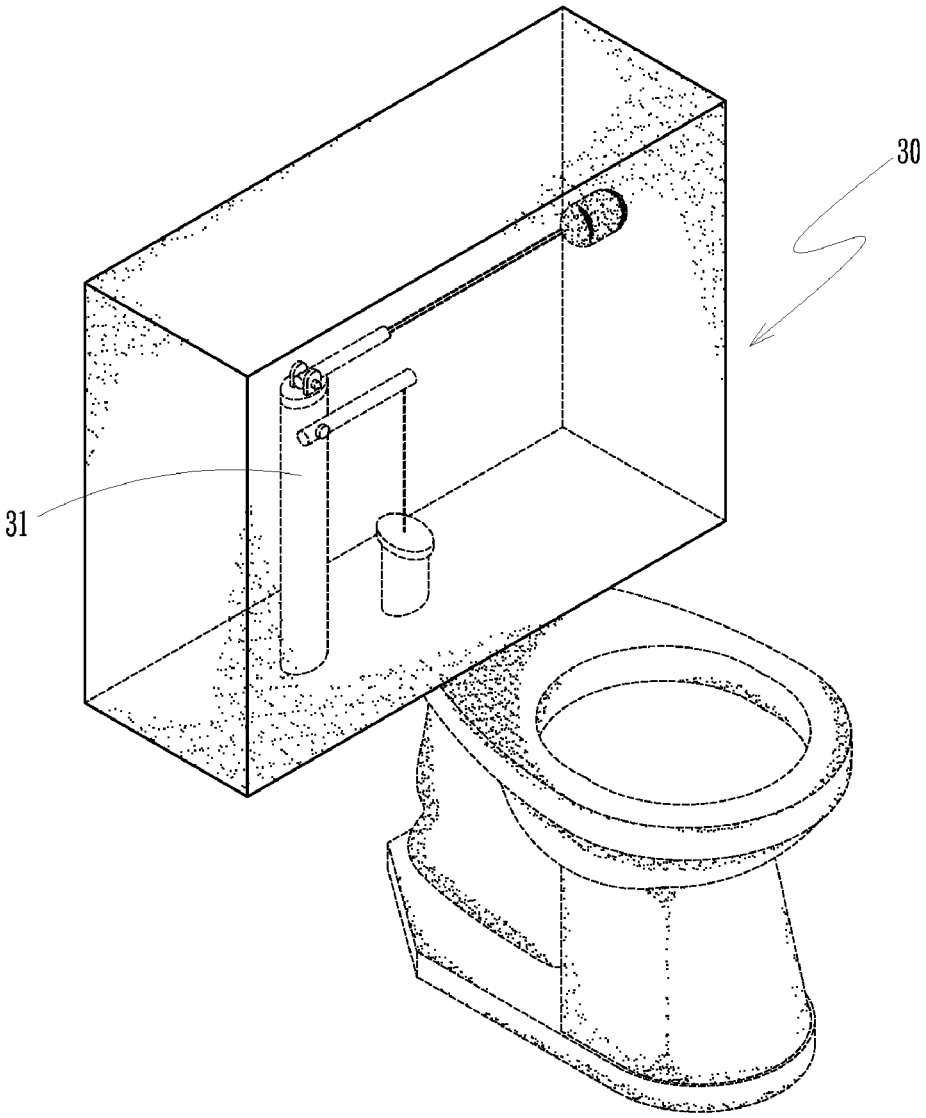
FIG. 6 is a perspective view of the conventional flush toilet.

Referring to FIGS. 3 to 5 are the perspective and plan views schematically showing the supplying of water from the auxiliary tank to the main tank and the refilling of water from the water refilling pipe to the main tank. Wherein, the one end of the pulling line 112 in the auxiliary tank 10 is connected with the floating ball 113, then the line 112 is wound from the lower pulley 110 to the upper pulley 111, and passed through the penetrated hole 120 of the hollow tube 12, finally connected with the extension arm 210 of the water refilling pipe 21 in the main tank 20 with its other end. In addition, the flapper cover 211A of the floating arm 211 is covered to the bottom hole 13 of the auxiliary tank 10. Since the one end of the pulling line 112 is connected with the extension arm 210 of the water refilling pipe 21, when the water level in the main tank 20 is decreased, the extension arm 210 of the water refilling pipe 21 will be hold by the pulling line 112, but the floating arm 211, which is pivotally connected with the extension arm 210, will be downwardly inclined with respect to the pivotal joint 210A of the extension arm 210, so the flapper cover 211A will be released from covering the bottom hole 13 of the auxiliary tank 10, then the water stored in the auxiliary tank 10 will be able to supply into the main tank 20. In the light of above, the flush of the toilet is still able to be operated even at the time of water outage or shutting off the water valve. When the stored water of the auxiliary tank 10 is insufficient, and the water level of the main tank 20 is decreased as well, the floating ball 113 in the auxiliary tank 10 will drop off accordingly to cause the pulling line 112 becoming loose, and that will result in the extension arm 210 to incline downwardly with respect to the water refilling pipe 21, further to activate the refilling of water into the main tank 20 from the water refilling pipe 21.

Referring to FIGS. 3 to 5 are the perspective and plan views schematically showing the movements of the extension arm and the floating arm of the present invention. Wherein, the one end of the pulling line 112 is connected with the floating ball 113 of the auxiliary tank 10, and the other end is connected with the extension arm 210 where the line 112 is wound from the lower pulley 110 to the upper pulley 111, then passed through the penetrated hole 120 of the hollow tube 12 (as shown in FIG. 2). When the water level in the main tank 20 is full, the extension arm 210 and the floating arm 211 are staying in alignment, therefore the flapper cover 211A of the floating arm 211 is covered to the bottom hole 13 of the auxiliary tank 10, to prevent from the water in the auxiliary tank 10 to supply into the main tank 20. On the contrary, when the water level in the main tank 20 is decreased, the extension arm 210 of the water refilling pipe 21 will be hold by the pulling line 112 of the floating lever 11, but the floating arm 211, which is pivotally connected with the extension arm 210, will be downwardly inclined with respect to the pivotal joint 210A of the extension arm 210, so the flapper cover 211A will be released from covering the hole 13 of the auxiliary tank 10, so that the water stored in the auxiliary tank 10 will be supplied into the main tank 20. When the stored water of the auxiliary tank 10 is insufficient, and the water level of the main tank 20 is decreased as well, the floating ball 113 in the auxiliary tank 10 will drop off accordingly to cause the pulling line 112 becoming loose, and that will result in the extension arm 210 to incline downwardly with respect to the water refilling pipe 21, further to activate the refilling of water into the main tank 20 from the water refilling pipe 21.

In the light of the above, the advantages of the present invention include:

1. Convenience: When the water level in the main tank 20 is decreased, the floating arm 211, which is pivotally connected with the extension arm 210, will be downwardly inclined with respect to the pivotal joint 210A of the extension arm 210, so the flapper cover 211A will be released from covering the hole 13 of the auxiliary tank 10, so that the water stored in the auxiliary tank 10 will be supplied to the main tank 20; in the light of above, the flush of the toilet is still able to be operated even at the time of water outage or shutting off the water valve, so the use of the present invention is convenience; and 2. Stability: When the water level in the main tank 20 is decreased, the water stored in the auxiliary tank 10 will be supplied to the main tank 20, to prevent from the water outage or shutting off the water valve. When the stored water of the auxiliary tank 10 is insufficient, and the water level of the main tank 20 is decreased as well, the refilling of the water into the main tank 20 from the water refilling pipe 21 will be activated, so the use of the present invention is stable.

Although numerous characteristics and advantages of the present invention have been described in detail in the foregoing description, together with the structure and function of the invention, this disclosure is only one of the examples, and changes may be made with regard to specific details, particularly to shape, size, and arrangement of parts within the invention to the full extent indicated by the general meaning of the terms in which the appended claims are expressed.

What is claimed is:

1. A flush toilet, comprising:

an auxiliary tank having a floating lever, a hollow tube and a bottom hole, wherein the floating lever further includes a pulling line and a floating ball; and the hollow tube further comprises a penetrated hole; the pulling line in the auxiliary tank is connected with a floating ball with its one end, and passed through a penetrated hole of the hollow tube; and a main tank having a water refilling pipe which comprises an extension arm having a pivotal joint, and a floating arm is pivotally assembled to such pivotal joint; the extension arm, which is pivotally connected with the water refilling pipe, is connected with the other end of the pulling line where the line has been passed through the penetrated hole of the hollow tube.

2. A flush toilet as claimed in claim 1, wherein the floating lever of the auxiliary tank further includes a lower pulley and an upper pulley, the pulling line which is connected with a floating ball with its one end, then the line is wound from the lower pulley to the upper pulley.

3. A flush toilet as claimed in claim 1, wherein a flapper cover is installed on the floating arm, and the flapper cover is covered to the bottom hole of the auxiliary tank.

* * * * *